US011739575B2

(12) United States Patent
Promutico et al.

(10) Patent No.: US 11,739,575 B2
(45) Date of Patent: Aug. 29, 2023

(54) DEVICE FOR LOCKING A HOUSEHOLD APPLIANCE DOOR

(71) Applicant: Bitron S.p.A., Turin (IT)

(72) Inventors: Fabrizio Promutico, Turin (IT); Marcello Pollastri, Turin (IT); Andrea Saccocci, Turin (IT)

(73) Assignee: Bitron S.p.A., Turin (IT)

( * ) Notice: Subject to any disclaimer, the term of this patent is extended or adjusted under 35 U.S.C. 154(b) by 95 days.

(21) Appl. No.: 17/329,246

(22) Filed: May 25, 2021

(65) Prior Publication Data

US 2021/0363802 A1 Nov. 25, 2021

(30) Foreign Application Priority Data

May 25, 2020 (IT) ..... 102020000012172

(51) Int. Cl.
*E05C 19/02* (2006.01)
*E05C 5/00* (2006.01)
*E05B 17/00* (2006.01)

(52) U.S. Cl.
CPC ..... *E05C 19/024* (2013.01); *E05C 5/00* (2013.01); *E05B 17/0025* (2013.01); *E05C 2005/005* (2013.01); *E05Y 2900/30* (2013.01)

(58) Field of Classification Search
CPC ..... Y10T 292/0911; Y10T 292/0886; Y10T 292/0887; Y10T 292/0889; Y10T 292/089;
(Continued)

(56) References Cited

U.S. PATENT DOCUMENTS 2,790,665 A * 4/1957 Vanderveld ..... E05C 19/02 292/341.17
6,290,270 B1 * 9/2001 Spiessl ..... E05C 3/24 292/216
(Continued)

FOREIGN PATENT DOCUMENTS

DE 553587 C * 1/1931 ..... E05C 19/024
DE 1004963 B * 5/1954 ..... E05B 65/0046
(Continued)

OTHER PUBLICATIONS

DE1105309B Espacenet machine translation performed on Nov. 4, 2022 (Year: 1961).*
(Continued)

*Primary Examiner* — Kristina R Fulton
*Assistant Examiner* — Steven A Tullia

(57) ABSTRACT

The present invention relates to a Door-locking device (1) for a household appliance (E), said household appliance (E) being of the type comprising a door provided with a lug (14), said door locking device (1) comprising a containment casing (10), fixable to said household appliance (E), a hook (11), arranged into said containment casing (10), capable of moving from a disengagement position, in which said lug (14) does not contact said hook (11), to an engagement position, in which said lug (14) is engaged with said hook (11) and said hook (11) is free to move along the movement direction of said lug (14), an abutment element (15) fixed on said containment casing (10), and elastic means (13), interposed between said hook (11) and said abutment element (15), wherein when said hook (11) is in said disengagement position, said elastic means (13) are compressed, and when said hook (11) is in said engagement position, said elastic means (13) expand, so that said hook (11) moves.

10 Claims, 2 Drawing Sheets

(58) Field of Classification Search
CPC ... Y10T 292/0893; E05C 19/024; E05C 5/00; E05C 2005/005; E05C 19/02; E05C 5/02; E05B 17/0025; E05Y 2900/30
See application file for complete search history.

(56) References Cited

U.S. PATENT DOCUMENTS

| | | | | |
|---|---|---|---|---|
| 6,390,518 | B1 * | 5/2002 | Elick | E05C 3/24 292/96 |
| 6,523,867 | B1 | 2/2003 | Yeh | |
| 7,210,711 | B2 * | 5/2007 | Dirnberger | E05C 3/24 292/68 |
| 9,487,976 | B2 * | 11/2016 | Ala | E05B 15/0086 |
| 2003/0160461 | A1 * | 8/2003 | Promutico | E05C 5/00 292/216 |
| 2010/0314889 | A1 * | 12/2010 | Wang | E05C 19/024 292/97 |
| 2012/0292924 | A1 * | 11/2012 | Promutico | D06F 39/14 292/113 |
| 2014/0329659 | A1 * | 11/2014 | Le Guyader | B04B 7/02 494/82 |

FOREIGN PATENT DOCUMENTS

| | | | | | |
|---|---|---|---|---|---|
| DE | 1105309 | B | * | 5/1959 | E05C 19/024 |
| DE | 1130730 | B | * | 10/1959 | E05C 19/024 |
| DE | 1073898 | | | 1/1960 | |
| DE | 1131119 | B | * | 10/1960 | E05C 19/024 |
| DE | 1158403 | B | * | 2/1962 | E05C 19/024 |
| DE | 3626956 | A1 | * | 8/1986 | E05C 3/24 |
| DE | 9105416 | U1 | * | 5/1991 | E05B 65/462 |
| DE | 102010051518 | A1 | * | 5/2012 | A47L 15/4259 |
| EP | 1304436 | | | 4/2003 | |
| FR | 1232021 | A | * | 8/1959 | E05C 19/024 |
| FR | 2465058 | A1 | * | 8/1980 | E05C 19/024 |
| KR | 20140120883 | A | * | 1/2013 | E05C 3/24 |
| WO | WO 2012/070023 | | | 5/2012 | |

OTHER PUBLICATIONS

Rapporto di Ricerca e Opinione Scritta [Search Report and Written Opinion] dated Jan. 26, 2021 From the Ministero Dello Sciluppo Economic, Direzione Generale Sviluppo Produttivo e Competitivita, Ufficio Italiano Brevetti e Marchi Re. Application No. IT 202000012172. (10 Pages).

* cited by examiner

DEVICE FOR LOCKING A HOUSEHOLD APPLIANCE DOOR

RELATED APPLICATION

This application claims the benefit of priority of Italian Patent Application No. 102020000012172 filed on May 25, 2020, the contents of which are incorporated herein by reference in their entirety.

FIELD AND BACKGROUND OF THE INVENTION

The present invention relates to a device for locking a household appliance door.

More in detail, the invention relates to a device of the above type, designed and manufactured in particular to close a door of a household appliance, such as for example a dryer, a washing machine, and the like, but which can be used for any machinery or equipment, of which it is necessary to close a door.

In the following, the description will be directed to a device for closing a dryer, but it is clear that it should not be considered limited to this specific use.

Systems are currently known which are capable of locking the hatch or door of a household appliance following its closure by an operator.

In particular, these technical solutions make it possible to avoid, for example, the drying program being started in a dryer, before or without the door actually being closed and locked, for safety reasons.

However, these known solutions have drawbacks.

A first drawback of these known solutions consists in the fact that they comprise a large number of components.

A further drawback of these known solutions consists in the fact that they do not provide particularly compact structures.

This is in contrast with market needs, which require miniaturization of the components so that they can be installed in ever-smaller spaces.

SUMMARY OF THE INVENTION

The scope of the present invention is to overcome the aforementioned drawbacks by providing a device for closing a door of a household appliance.

Another object of the invention is to provide a device for closing a door of a household appliance which allows reducing the overall dimensions with respect to prior art systems.

Another object of the invention is to provide a device for closing a door of a household appliance that is highly reliable, relatively simple to manufacture, and at competitive costs if compared to the prior art.

It is therefore specific object of the present invention a door-locking device for a household appliance, said household appliance being of the type comprising a door provided with a lug, said door locking device comprising a containment casing, fixable to said household appliance, a hook, arranged into said containment casing, capable of moving from a disengagement position, in which said lug does not contact said hook, to an engagement position, in which said lug is engaged with said hook and said hook is free to move along the movement direction of said lug, an abutment element fixed on said containment casing, and elastic means, interposed between said hook and said abutment element, wherein when said hook is in said disengagement position, said elastic means are compressed, and when said hook is in said engagement position, said elastic means expand, so that said hook moves.

Always according to the invention, said elastic means may comprise a first arm, coupled to said hook, and a second arm, opposite to said first arm, and coupled to said abutment element, so that, when said hook is in said disengagement position, said first arm and said second arm are at a first distance from each other, and, that, when said hook is in said engagement position, said first arm and said second arm are at a second distance from each other, wherein said second distance is higher than said first distance.

Still according to the invention, said hook may have a first opening, having an inner surface, and a slot, opposite to said first opening, wherein said abutment element is inserted in said slot, so that said hook is capable of rotating with respect to said abutment element, when said hook moves from said disengagement position to said engagement position.

Advantageously according to the invention, said elastic means may comprise a main portion, wherein said first arm has a first end connected to said central portion, and a second end, opposite to said first end, and connected to said inner surface of said first opening, and wherein said second arm has a first end connected to said central portion, and a second end, opposite to said first end, and connected to said abutment element.

Further according to the invention, said device may comprise a locking and sliding element, fixed on, or obtained in said containment casing, and said hook may have a locking or unlocking portion shaped for locking, in use, said hook to said locking and sliding element, and a hook portion, opposite to said locking and unlocking portion, intended to engage, in use, with said lug.

Always according to the invention, when said hook is in said disengagement position, said second end of said first arm may exert pressure on said inner surface of said opening close to said locking or unlocking portion, and, so, on said locking and sliding element, and said second end of said second arm exerts pressure on said abutment element, so that said hook is locked in said disengagement position.

Still according to the invention, said locking or unlocking portion may have a first notch shaped so that, when said hook is in said disengagement position, said first notch contacts said locking and sliding element, so that said hook is locked in said disengagement position, and said hook portion may have a second notch shaped so that, when said hook is in use, said second notch receives said lug, allowing said second notch to engage with said lug.

Advantageously according to the invention, said locking and sliding element my comprise a pin and a protection and sliding element around said pin, wherein said protection and sliding element is concentric around said pin and contact said pin.

Further according to the invention, said elastic elements may be a torsion spring.

BRIEF DESCRIPTION OF THE SEVERAL VIEWS OF THE DRAWINGS

The present invention will be now described, for illustrative but not limitative purposes, according to its preferred embodiments, with particular reference to the figures of the enclosed drawings, wherein.

In the various figures, similar parts will be indicated by the same reference numbers.

DESCRIPTION OF SPECIFIC EMBODIMENTS OF THE INVENTION

Figure 2:
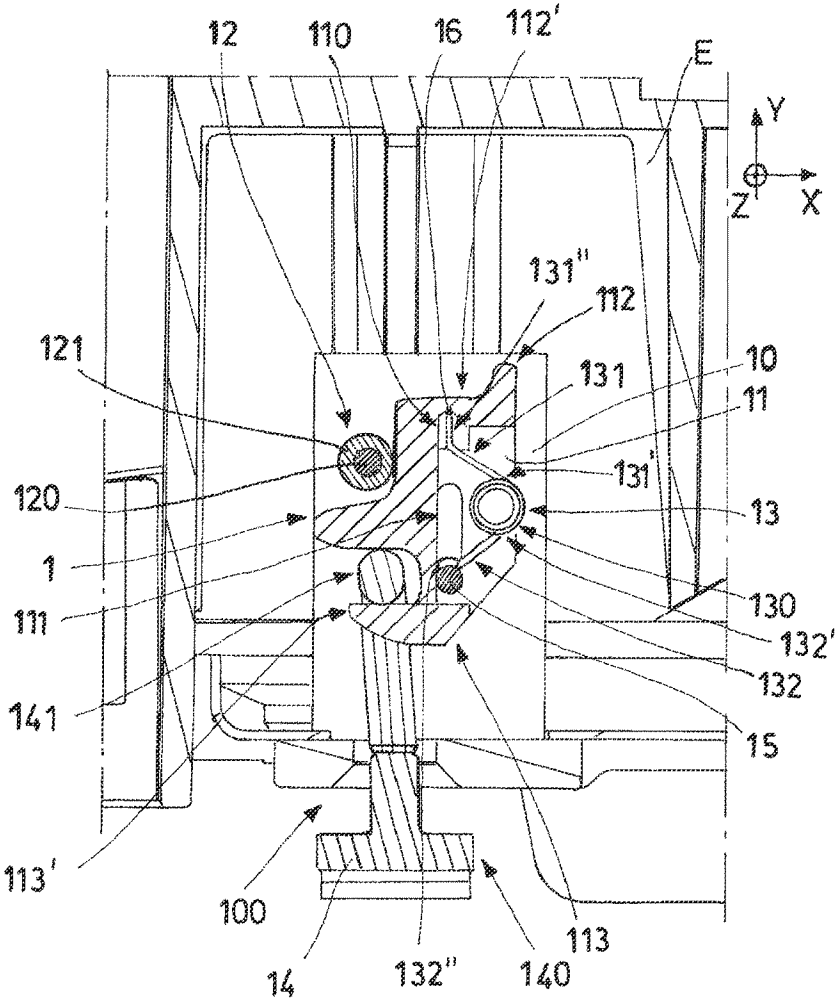
FIG. 2 illustrates a top sectional view of the device of FIG. 1 in an operating position, in which the door is closed.
Figure 1:
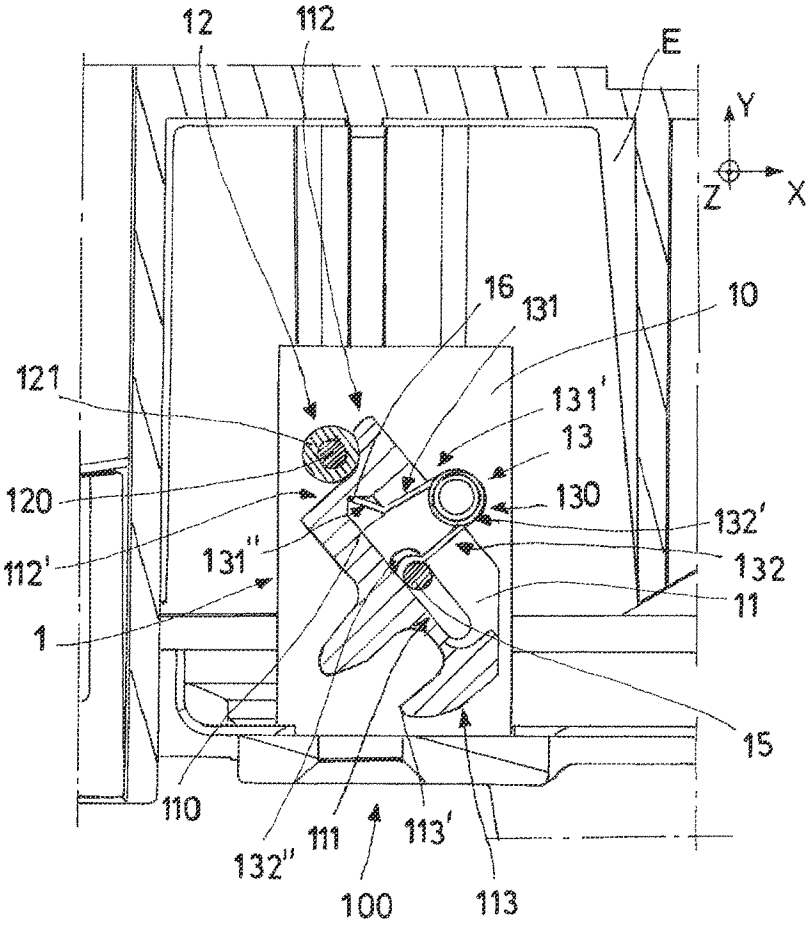
FIG. 1 illustrates a top sectional view of an embodiment of a device for closing a door of a household appliance in a rest position, in which the door is open, according to the present invention.

With reference to the above mentioned FIGS. 1-3C, the device for closing a door (not shown in the figures) of a household appliance E, wholly indicated with the reference number 1, substantially comprises a containment casing or container 10, a hook 11, arranged within said containment casing 10, and capable of passing from a disengagement or rest position to an engaging or operative position, a locking and sliding element 12 and an abutment or abutment element 15, both fixed on said containment casing 10, elastic means 13, connected to said hook 11 and to said abutment element 15, and capable of passing from a first position to a second position.

The containment casing 10 is hollow and is intended to contain the components of said device 1. Said containment casing 10 is fixed to said household appliance E.

In particular, as will be better described hereinafter, said containment casing 10 has an opening 100 capable of receiving the lug 14 of said door when the same door is closed by the operator.

In the embodiment described, said containment casing 10 has a substantially rectangular section and is made of plastic material.

However, in further embodiments, the section and the material of said containment casing 10 can be different.

The hook 11 has a first opening 110 and a second opening or slot 111, opposite to said first opening 110.

As it will be better described below, said first opening 110 has an internal surface S, connected to said elastic means 13, while said slot 111 allows said hook 11 to move with respect to the abutment element 15, fixed on said containment casing 10 and inserted inside said slot 111.

Furthermore, said hook 11 has a locking or unlocking portion 112 shaped to lock or unlocking said hook with respect to said locking and sliding element 12, and a hook portion 113, opposite to said locking or unlocking portion 112, intended to contact said lug 14 of the door of said household appliance E.

More specifically, said locking or unlocking portion 112 has a first recess 112', shaped in such a way that, when said hook 11 is in said rest position, said first recess 112' contacts said locking and sliding element 12, allowing said locking or unlocking portion 112 engaging thereto.

Said hook portion 113, on the other hand, has a second recess 113', shaped in such a way that, when said hook 11 is in use, said second recess 113' receives said lug 14, as will be better explained below.

Said locking and sliding element 12, fixed on said containment casing 10, comprises a pin or a spine 120 and a protection and sliding element 121 arranged around said pin 120.

In particular, as can be seen from FIGS. 1-3C, said protection and sliding element 121 is concentric with said pin 120 and contacts said pin 120.

More specifically, said protection and sliding element 121 allows protecting said pin 120 from possible collisions with other components of said device 1.

In addition, said protection and sliding element 121 allows, as will be described in more detail below, said hook 11 to pass from said rest position to said operative position by means of a movement around said protection and sliding element 121.

Said abutment element 15, as said, is inserted within said slot 111 of said hook 11 and is fixed to said containment casing 10. This allows the movement and the rotation of said hook 11 to be constrained around said abutment element 15.

In the present embodiment said abutment element 15 is a pin. However, in further embodiments, said abutment element 15 can be different from said pin.

Said elastic means 13, such as a torsion spring and the like, as said, are connected to said internal surface S of said hook 11 and to said abutment element 15, and are capable of passing from said first position, in which they have a compressed shape, to a second position, in which they have an extended or elongated shape.

More specifically, said elastic means 13 comprise a main portion 130, a first arm 131, and a second arm 132, opposite to said first arm 131.

Said first arm 131 has a first end 131', coupled to said central portion 130, and a second end 131", opposite said first end 131', and coupled to said internal surface S of said hook 11, for example, by means of connecting means 16, such as screws and the like.

Said second arm 132 has a first end 132' coupled to said central portion 130, and a second end 132", opposite said first end 132', and coupled to said abutment element 15.

In particular, as will be better described below, when said hook 11 is in said rest position, said elastic means 13 are in said first position, in which said first arm 131 and said second arm 132 are at a first distance D1, while, when said hook 11 is in said operative position, said elastic means 13 are in said second position, in which said first arm 131 and said second arm 132 are at a second distance D2, greater than said first distance D1.

The lug 14 mounted on the door of said household appliance E, as said, is capable of engaging, in use, with said hook 11, arranged within said containment casing 10, fixed to said household appliance E.

In particular, said lug 14 comprises a first end 140, connected to the door of the household appliance E, and a second end 141, opposite to said first end 140, capable of engaging, in use, with said hook 11.

More specifically, said lug 14 is capable of passing from a rest position, in which said second end 141 does not contact said hook 11, to an operative position, in which said second end 141 is inserted in said opening 100 and is engaged with said second recess 113' of said hook portion 113 of said hook 11.

The operation of the device 1 described above is as follows.

Figure 3C:
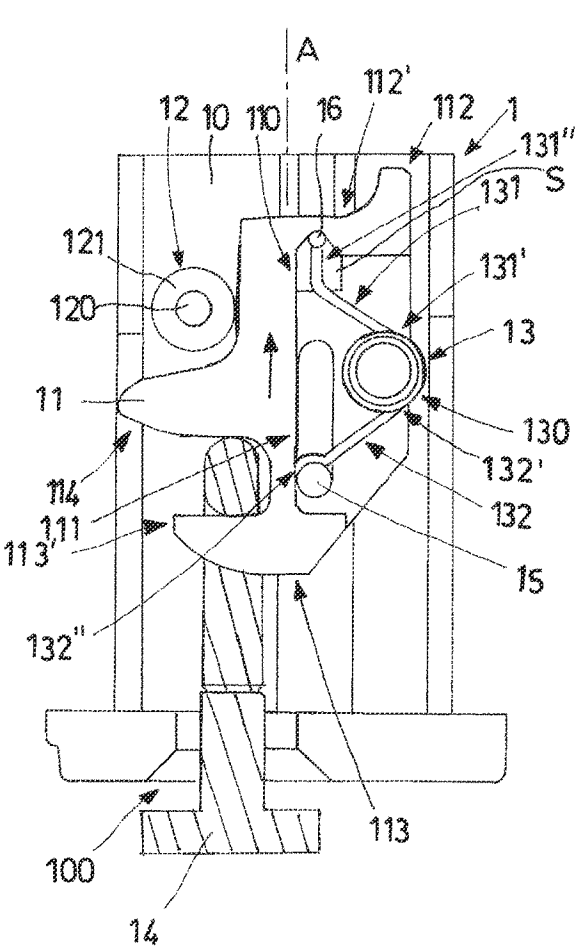
FIG. 3C illustrates a further sectional view from above of the device of FIG. 1 in the operative position.
Figure 3B:
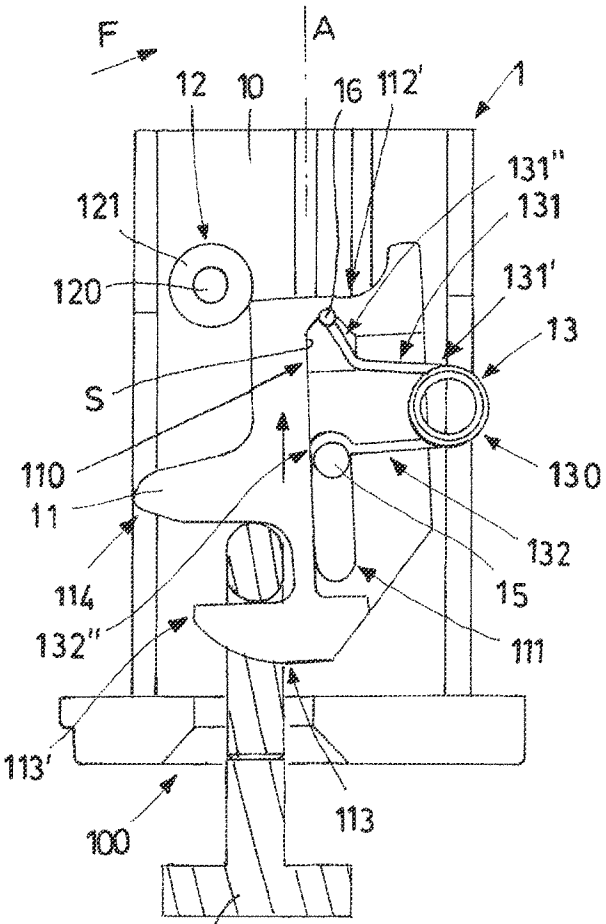
FIG. 3B illustrates a top sectional view of the device of FIG. 1 in an intermediate position.
Figure 3A:
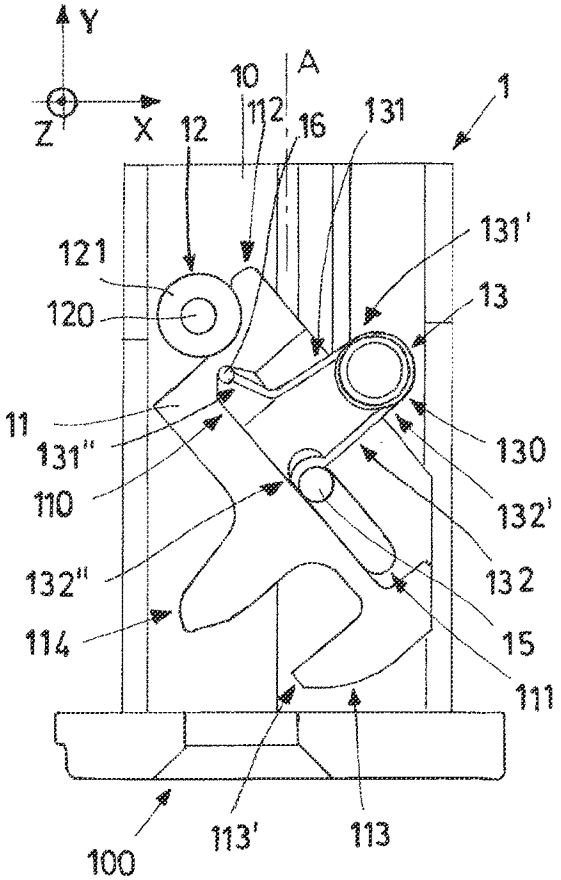
FIG. 3A illustrates a further sectional view from above of the device of FIG. 1 in the rest position.

With reference to FIG. 3A, the device 1 is in the rest position.

In fact, in this configuration the door of the household appliance E is open, i.e., said lug 14 is in said rest position, said hook 11 is in said rest position, and said elastic means 13 are in said first position, in which they are compressed.

More in detail, as can be seen from FIG. 3A, said first recess 112' of said locking or unlocking portion 112 of said hook 11 contacts said locking and sliding element 12 in such a way that said hook 11 is locked in said rest position.

Furthermore, said second end 131" of said first arm 131, connected to said hook 11, for example, by means of connecting means 16, exerts a pressure on the internal surface S of said opening 110, which is close to said first end 112 of said hook 11 and, therefore, on said locking and sliding element 12, which contacts said locking or unlocking portion 112.

Similarly, said second end 132" of said second arm 132, connected to said abutment element 15, exerts a pressure on said abutment element 15.

Said first arm 131 and said second arm 132 are at a first distance D1 from each other.

Therefore, the pressure exerted by said first arm 131 and by said second arm 132, respectively on said first end 112 of said hook 11 and on said abutment element 15, allows said hook 11 to maintain said rest position.

With reference to FIG. 3B, the device 1 is in an intermediate position, between said rest position and said operative position.

In fact, the door of the household appliance E is not yet closed, said lug 14 is in said operative position, said hook 11 is in an intermediate position, and said elastic means 13 are in said first position, in which they have a compressed shape.

More specifically, the pressure exerted by said operator to close the door, by means of said lug 14, on a projection 114 of said hook 11 causes a rotation of said hook 11 with respect to said locking and sliding element 12 and said abutment element 15 (in the direction indicated by the direction indicator F in FIG. 3B), and at the same time the insertion of said second end 141 of said lug 14 in said opening 100.

In fact, when the operator closes the door of the household appliance E, said second end 141 of said lug 14 is inserted into said opening 100 and engages with said second recess 113' of said hook portion 113 of said hook 11.

In addition, said portion 112 for locking or releasing said hook 11 partially contacts said locking and sliding element 12, in such a way that said hook 11 is free to move along the direction of an axis A, parallel to the Y-axis of a Cartesian reference system XYZ and perpendicular to the XZ plane that delimits said opening 100.

Furthermore, said second end 131" of said first arm 131, connected to said hook 11, for example, by means of connecting means 16, exerts a pressure on said first end 112 of said hook 11 along said axis A.

Said second end 132" of said second arm 132, on the other hand, connected to said abutment element 15, continues to exert a pressure on said abutment element 15.

Therefore, in said intermediate position, the pressure exerted by said first arm 131 and by said second arm 132 of said elastic means 13, respectively on said portion 112 for locking or unlocking said hook 11, and on said abutment element 15, allows said hook 11 to pass from said intermediate position to said operative position. Therefore, said hook 11 is free to translate along the movement direction of said lug 14.

Finally, with reference to FIG. 3C, the device 1 is in the operative position.

The door of the household appliance E is closed, said lug 14 is in said operative position, said hook 11 is in said operative position, and said elastic means 13 are in said second position, in which they have an elongated shape.

More specifically, said first recess 112' of said first end 112 of said hook 11 does not contact said locking and sliding element 12.

Said locking and sliding element 12, on the other hand, contacts said projection 114 of said hook 11, preventing said hook 11 from carrying out further movements along said axis A.

Similarly, said abutment element 15 prevents said hook 11 from carrying out further movements along said axis A.

In other words, said locking and sliding element 12 and said abutment element 15 represent respective end of strokes of said hook 11.

Furthermore, said second end 131" of said first arm 131, connected to said hook 11, for example, by means of connecting means 16, continues to exert a pressure on said portion 112 for locking or unlocking said hook 11.

Similarly, said second end 132" of said second arm 132, connected to said abutment element 15, continues to exert a pressure on said abutment element 15.

Said first arm 131 and said second 132 arm are at a second distance D2, which is greater than said first distance D1.

Therefore, the pressure exerted by said elastic means 13 on said hook 11 and on said abutment element 15 allows said hook 11 and, therefore, said device 1, to move from said intermediate position to said operative position, without any manual intervention.

More specifically, the passage of said device 1 from said intermediate position to said operative position occurs due to the achievement of a balance between two forces, namely, between the pressure force exerted by said elastic means 13 on said hook 11 and on said abutment element 15 allows said hook 11, and the return force of said hook 11.

In particular, in an embodiment of the present invention, said device 1 provides for the presence of an overtravel, or a further stop space with respect to the end of stroke of said hook 11, referred to the end of the path of said hook 11 with respect to the direction of said axis A.

In fact, the presence of this overtravel makes it possible to avoid any damage to the mechanical components of said device 1, when, for example, said door of said household appliance E is forced closed by the operator.

Advantages

An advantage of the device for closing a door of a household appliance according to the present invention is that of reducing the overall dimensions with respect to the prior art systems.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. Door-locking device (1) for a household appliance (E), said household appliance (E) comprising a door provided with a lug (14), said door locking device (1) comprising a containment casing (10), fixable to said household appliance (E), a hook (11), arranged into said containment casing (10), capable of moving from a disengagement position, in which said lug (14) does not contact said hook (11), to an engagement position, in which said lug (14) is engaged with said hook (11) and said hook (11) is free to move along the movement direction of said lug (14), an abutment element (15) fixed on said containment casing (10), and elastic means (13), interposed between said hook (11) and said abutment element (15), wherein when said hook (11) is in said disengagement position, said elastic means (13) are compressed, and when said hook (11) is in said engagement position, said elastic means (13) expand, so that said hook (11) moves, wherein said hook (11) has a first opening (110), having an inner surface (S) and a slot (111), opposite to said first opening (110), wherein said abutment element (15) is inserted in said slot (111), so that said hook (11) is capable of rotating with respect to said abutment element (15), when said hook (11) moves from said disengagement position to said engagement position.

2. Device (1) according to claim 1, characterized in that said elastic means (13) comprise a first arm (131), coupled to said hook (11), and a second arm (132), opposite to said first arm (131), and coupled to said abutment element (15), so that, when said hook (11) is in said disengagement position, said first arm (131) and said second arm (132) are at a first distance (D1) from each other, and, that, when said hook (11) is in said engagement position, said first arm (131) and said second arm (132) are at a second distance (D2) from each other, wherein said second distance (D2) is greater than said first distance (D1).

3. Device (1) according to claim 2, characterized in that said elastic means (13) comprise a main portion (130), wherein said first arm (131) has a first end (131') connected to said central portion (130), and a second end (131"), opposite to said first end (131'), and connected to said inner surface (S) of said first opening (110), and wherein said second arm (132) has a first end (132') connected to said central portion (130), and a second end (132"), opposite to said first end (132'), and connected to said abutment element (15).

4. Device (1) according to claim 3, characterized in that said door locking device (1) comprises a locking and sliding element (12), fixed on, or obtained in said containment casing (10), and in that said hook (11) has a locking or unlocking portion (112) shaped for locking, in use, said hook (11) to said locking and sliding element (12), and a hook portion (113), opposite to said locking and unlocking portion (112), adapted to engage, in use, with said lug (14).

5. Device (1) according to claim 4, characterized in that, when said hook (11) is in said disengagement position, said second end (131") of said first arm (131) exerts pressure on said inner surface (S) of said opening (110) close to said locking or unlocking portion (112), and, so, on said locking and sliding element (12), and said second end (132") of said second arm (132) exerts pressure on said abutment element (15), so that said hook (11) is locked in said disengagement position.

6. Device (1) according to claim 4, characterized in that said locking or unlocking portion (112) has a first notch (112') shaped so that, when said hook (11) is in said disengagement position, said first notch (112') contact said locking and sliding element (12), so that said hook (1) is locked in said disengagement position, and in that said hook portion (113) has a second notch (113') shaped so that, when said hook (11) is in use, said second notch (113') receives said lug (14), allowing said second notch (113') to engage with said lug (14).

7. Device (1) according to claim 4, characterized in that said locking and sliding element (12) comprises a pin (120) and a protection and sliding element (121) around said pin (120), wherein said protection and sliding element (121) is concentric around said pin (120) and contact said pin (120).

8. Device (1) according to claim 1, characterized in that said elastic means (13) are a torsion spring (13).

9. Device (1) according to claim 1, characterized in that said elastic means (13) comprise a main portion (130), wherein said first arm (131) has a first end (131') connected to said central portion (130), and a second end (131"), opposite to said first end (131'), and connected to said inner surface (S) of said first opening (110), and wherein said second arm (132) has a first end (132') connected to said central portion (130), and a second end (132"), opposite to said first end (132'), and connected to said abutment element (15).

10. Device (1) according to claim 1, characterized in that said door locking device (1) comprises a locking and sliding element (12), fixed on, or obtained in said containment casing (10), and in that said hook (11) has a locking or unlocking portion (112) shaped for locking, in use, said hook (11) to said locking and sliding element (12), and a hook portion (113), opposite to said locking and unlocking portion (112), adapted to engage, in use, with said lug (14).

* * * * *